US006818080B2

(12) United States Patent
Sakamoto et al.

(10) Patent No.: US 6,818,080 B2
(45) Date of Patent: Nov. 16, 2004

(54) METHOD FOR MANUFACTURING SHAPED LIGHT METAL ARTICLE

(75) Inventors: Kazuo Sakamoto, Hiroshima (JP); Yasuo Uosaki, Hiroshima (JP); Nobuo Sakate, Hiroshima (JP)

(73) Assignee: Mazda Motor Corporation, Hiroshima (JP)

( * ) Notice: Subject to any disclaimer, the term of this patent is extended or adjusted under 35 U.S.C. 154(b) by 240 days.

(21) Appl. No.: 10/000,480

(22) Filed: Dec. 4, 2001

(65) Prior Publication Data

US 2002/0046592 A1 Apr. 25, 2002

Related U.S. Application Data

(63) Continuation of application No. PCT/JP01/03028, filed on Apr. 9, 2001.

(30) Foreign Application Priority Data

Apr. 7, 2000 (JP) ..... 2000-106375

(51) Int. Cl.[7] ..... C21D 1/00
(52) U.S. Cl. ..... 148/667; 148/666
(58) Field of Search ..... 148/666, 667

(56) References Cited

U.S. PATENT DOCUMENTS

| | | | |
|---|---|---|---|
| 1,689,630 | A | 10/1928 | Archer et al. |
| 1,936,550 | A | 11/1933 | Gann et al. |
| 2,030,767 | A | 2/1936 | Schmidt et al. |
| 3,014,824 | A | 12/1961 | Zvanut et al. |
| 5,902,424 | A | 5/1999 | Fujita et al. |

FOREIGN PATENT DOCUMENTS

| | | |
|---|---|---|
| DE | 951 045 | 10/1956 |
| DE | 1 180 537 | 10/1960 |
| EP | 0845321 | * 6/1998 |
| EP | 0 905 266 | 3/1999 |
| GB | 639808 | 7/1950 |
| JP | 06-248402 | 9/1994 |
| JP | 09-263871 | 10/1997 |
| JP | 11-100632 | 4/1999 |
| JP | 11-104800 | 4/1999 |

OTHER PUBLICATIONS

U.S. patent application Publication, US 20003/0145918 by Sakamoto et., published Aug. 7, 2003.*
J.E. Hatch, "*Aluminum*" 1987 American Society for Metals, Ohio, U.S. XP002179951, p. 116–p. 125; Figure 13.
Notice of Reasons of Rejection Dated Oct. 21, 2003 for Japanese patent application No. 2000–106375.

* cited by examiner

*Primary Examiner*—Sikyin Ip
(74) *Attorney, Agent, or Firm*—NixonPeabody, LLP; Donald R. Studebaker

(57) ABSTRACT

A manufacturing method for a shaped light metal article includes the steps of forming a plastic worked article by plastic working an article for plastic working made of light metal material, and subjecting the plastic worked article to a post-plastic working heat treatment for between 20 minutes and 10 hours at a temperature in a range of 250 to 400° C. As a result, a shaped light metal article is produced with sufficient ductility.

5 Claims, 9 Drawing Sheets

Fig. 2
| | Al | Zn | Mn | Si | Cu | Ni | Fe | Mg |
|---|---|---|---|---|---|---|---|---|
| Alloy A | 9.1 | 0.78 | 0.24 | – | 0.001 | 0.0009 | 0.003 | Remainder |
| Alloy B | 6.9 | 0.60 | 0.23 | 0.01 | 0.002 | 0.0005 | 0.002 | Remainder |
| Alloy C | 7.2 | 0.2 | 0.22 | – | 0.001 | 0.0008 | 0.003 | Remainder |
Units: mass. %
Fig. 3A
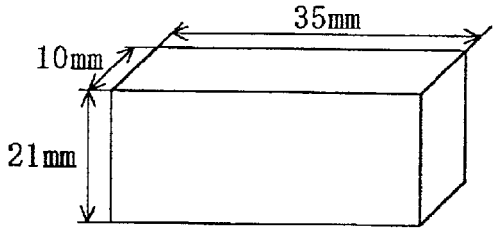
Fig. 3B
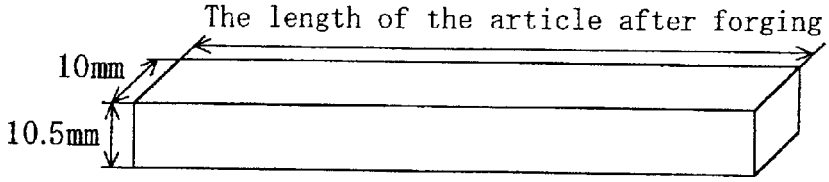

T6 treatment processing temperature =300℃ processing temperature =350℃ processing temperature =400℃

T6 treatment processing temperature =300℃ processing temperature =350℃ processing temperature =400℃

Alloy A before heat treatment

Alloy B before heat treatment

Alloy A after heat treatment

Alloy B after heat treatment

METHOD FOR MANUFACTURING SHAPED LIGHT METAL ARTICLE

DESCRIPTION

This application is a Continuation of International Application No. PCT/JP01/03028, filed Apr. 9, 2001.

FIELD OF THE INVENTION

The present invention relates to a manufacturing method for shaped light metal article where an article for plastic working of light metal is plastic worked and the resulting plastic worked article is heat treated.

BACKGROUND OF THE INVENTION

One method of shaping metal materials is the plastic working method called "forging". Forging is where a metal material, such as a billet, is set in a die and is hammered into a desired shape. When forging a light metal material, it is customary to subject the forged articles produced by forging to a T6 heat treatment to improve the mechanical properties. A T6 heat treatment is a two-step heat treatment composed of a solution treatment, where a high temperature is maintained for a predetermined time to increase the homogeneity of a material composition, and subsequently an ageing precipitation hardening treatment, where a comparatively low temperature is maintained for a predetermined time to increase hardness.

Cast-forging, where casting and forging are combined, is another method for shaping a light metal material. Cast-forging is where casting is performed, such as by injection molding or die casting, to produce an article for forging in a shape that is close to the intended form, with the article for forging then being forged to work the article into the intended form Japanese Laid-Open Patent Publication H11-104800 (which corresponds to European Patent Publication: EP0905266 A1) discloses a method where forged article that has been shaped using cast-forging, which is made of a light metal material, is subjected to a T6 treatment composed of a solution treatment with a processing temperature in a range of 380 to 420° C. and a processing time in a range of 10 to 24 hours and an ageing precipitation hardening treatment with a processing temperature in a range of 170 to 230° C. and a processing time in a range of 4 to 16 hours.

However, when injection molding or die casting is used as the casting method performed during cast-forging, internal defects, such as gas defects, are produced in the article for forging. The number of such internal defects can be reduced, such as by having semimolten metal flow into the cavity or by improving the die, but it is extremely difficult to completely eradicate such internal defects. When article for forging include internal defects, there are the problems that performing a standard T6 heat treatment after forging does not sufficiently improve the mechanical characteristics and that the appearance of the forged article is spoilt by the creation of swelling-like blisters on their surface due to the expansion of gas defects during heat treatment.

The above problems can be solved by performing a pre-forging heat treatment with the aims of converting the article for forging to a solution and expanding the gas defects, and, after the heat-treated article for forging have been forged, a post-forging heat treatment with the aim of improving the mechanical properties. With this method, the forging process ruptures and eradicates some of the blisters that appear in the surface of the article for forging due to the expansion of gas defects during the pre-forging heat treatment, resulting in a reduction in the number of gas defects present in the forged article.

However, the post-forging heat treatment is performed under the same conditions as the ageing precipitation hardening treatment that forms part of the T6 treatment. This results in the problem of the shaped light metal article produced by this method having poor ductility.

SUMMARY OF THE INVENTION

It is an object of the present invention to provide a manufacturing method which optimizes the conditions for heat treatment performed on a plastic worked article after plastic working and so produces shaped light metal article with sufficient ductility.

In order to achieve the stated object, the present invention subjects a plastic worked article made of light metal material to a post-plastic working heat treatment that has a higher temperature and shorter processing time than the ageing precipitation hardening treatment performed in a standard T6 treatment.

In more detail, the present invention is a method of manufacturing a shaped light metal article, including the steps of forming a plastic worked article by plastic working an article for plastic working made of light metal material; and subjecting the plastic worked article to a post-plastic working heat treatment at a temperature in a range of 250 to 400° C. for between 20 minutes and 10 hours.

With the above method, a post-plastic working heat treatment that has a higher temperature and shorter processing time than the ageing precipitation hardening treatment of a T6 treatment is performed. As can be understood from the experiments described later in this specification, this enables ductility to be effectively improved, while maintaining the strength and yield strength.

A temperature range of 250 to 400° C. is used since a sufficient improvement in ductility cannot be achieved at temperatures below 250° C. and a significant decrease in yield strength occurs at temperatures above 400° C.

A processing time in a range of 20 minutes to 10 hours is used since a sufficient improvement in ductility cannot be achieved by processing for less than 20 minutes and there are cases where heat treatment for more than 10 hours results in a decrease in ductility. The processing time preferably is set at 5 hours or shorter, with 1 hour being optimal.

The expression "light metal material" refers to a metal, such as aluminum or magnesium, with a low density, or to an alloy of such. One specific example is AZ91D under ASTM Standards.

Plastic working here refers to forging or the like.

Even when the present kind of post-plastic working heat treatment is performed, the presence of a large number of internal defects such as gas defects in the plastic worked article subjected to this heat treatment stops the above effects from being sufficiently obtained.

In case that the light metal material is formed of light metal alloy, if the article for plastic working is subjected to a pre-plastic working heat treatment that uses a temperature that is lower than a temperature at which eutectic of the light metal alloy starts to be fused, blisters can be produced in the surface of the article for plastic working due to the expansion of gas defects included near the surface of the article for plastic working. Some of these blisters are ruptured and eradicated during the plastic working, thereby reducing the number of gas included defects in the plastic worked article.

The reason that the heat treatment is performed at the temperature lower than a temperature at which eutectic of the light metal alloy starts to be fused is that at a temperature equal to or higher than the temperature, the article for plastic working is partially fused and the material composition of the fused part is not homogenized, which involves a break from the fused part at the plastic working. It is preferable for the processing temperature to be in a range of 350° C. to 450° C. As blisters are created before plastic working and are eradicated by the plastic working, the further creation of blisters by the post-plastic working heat treatment can be suppressed, resulting in a favorable appearance for the shaped light metal article produced by this method.

When the processing time of the pre-plastic working heat treatment is one hour or longer, blisters can be effectively produced in the surface of the article for plastic working, and, in the same manner as the solution treatment performed in a T6 treatment, the homogeneity of the material composition can also be improved. For this reason, it is preferable for the processing time to be between 10 and 20 hours.

By making both the processing time and processing temperature of the pre-plastic working heat treatment respectively longer and higher than the processing time and processing temperature of the post-plastic working heat treatment, the post-plastic working heat treatment can be performed for a short time and a low temperature, thereby suppressing the creation of blisters by the post-plastic working heat treatment.

Internal defects that are included in the article for plastic working preferably take up no more than 10% as a percentage of volume. If internal defects take up no more than 10%, a plastic worked article with extremely few defects can be obtained even when using non-fully enclosed die plastic working, which makes the complete removal of internal defects difficult. If internal defects take up more than 10%, internal defects remain after the non-fully enclosed die plastic working, so that a plastic worked article with few internal defects can only be obtained if fully enclosed die plastic working is used. This is to say, by having internal defects included in the article for plastic working take up no more than 10%, a plastic worked article with few internal defects can be obtained without placing restrictions on the method of plastic working used.

When shaping the article for plastic working, it is preferable to introduce semimolten light metal into a cavity in a die and to solidify the semimolten light metal material to shape the article for plastic working. By doing so, molten metal enters the cavity as a laminar flow or near-laminar flow. This makes it difficult for air to become trapped in the material. As a result, an article for plastic working can be produced with few internal defects, such as gas defects or shrinkage cavities. This means that high-quality article for plastic working and shaped light metal article can be manufactured. Here, the expression "semimolten" refers to a state where some of the light metal material that is the raw material is still in a solid state while some of the light metal material has melted to turn into a liquid. Normally, this state can be achieved by heating a light metal raw material to below its melting point.

It is also preferable for the article for plastic working to be shaped by injection molding. This is because article for plastic working that has been shaped by injection molding has fewer internal defects due to the inclusion of air than an article produced by die casting method where atomized molten metal is used to fill a cavity in a die. Injection molding is even more effective if the molten light metal material is injected in a semimolten state below its melting point as described above.

This and other advantages of the present invention will become apparent to those skilled in the art upon reading and understanding the following detailed description with reference to the accompanying figures.

BRIEF DESCRIPTION OF THE DRAWINGS

FIG. 2 is a table showing the compositions of the alloys used in the experiments.

FIG. 3 contains perspective drawings showing the article for forging cutout of an injection molded article and the forged article.

DETAILED DESCRIPTION OF THE INVENTION

The following describes a method for manufacturing a shaped light metal article according to an embodiment of the present invention.

Casting Process-Injection Molding Process

Injection Molding Apparatus

Figure 1:
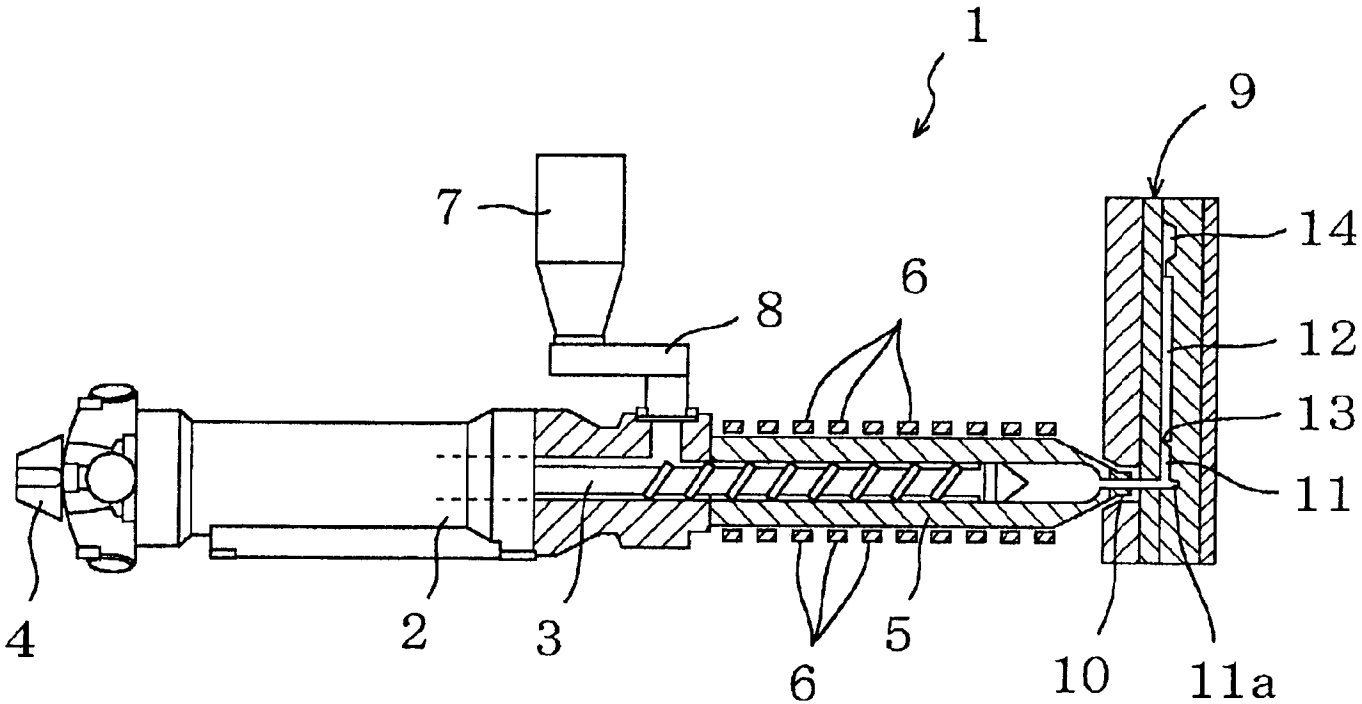
FIG. 1 shows a partially cross sectional view of the injection molding apparatus of an embodiment of the present invention.

FIG. 1 shows an injection molding apparatus 1 of the present embodiment. This injection molding apparatus 1 shapes an article for forging (an article for plastic working).

The injection molding apparatus 1 includes a main body 2, a screw 3 that is supported by the main body 2 so as to be freely rotatable, a rotation driving unit 4 that is arranged on the back of the main body 2 and rotationally drives the screw 3, a cylinder 5 that is fixed to the main body 2 so as to surround the screw 3, heaters 6 that are arranged around the circumference of the cylinder 5 at a predetermined pitch along the length of the cylinder 5, a hopper 7 for storing for light metal alloy raw materials that are introduced therein, a feeder 8 for measuring the material in the hopper 7 and supplying the material into the injection molding apparatus 1, and a die 9 that is attached to an end of the cylinder 5.

An injecting mechanism for propelling the screw 3 along the inside of the cylinder in the longitudinal direction 5 is provided on the main body 2. When the injecting mechanism detects that the screw 3 has retracted a preset distance due to the force of molten light metal alloy being transported forward, the injecting mechanism has the rotation and retraction of the screw 3 stopped, and, with a predetermined timing, has the screw 3 propelled forward to inject molten metal. The speed at which the screw 3 is propelled forward can be controlled, so that the speed at which the molten metal is introduced into a cavity 12 in the die can be controlled 9.

A nozzle 10 is provided at the end of the cylinder 5, so that molten metal that has been stirred and kneaded inside the cylinder 5 is injected into the cavity 12 via the nozzle 10. This injecting of molten metal into the cavity 12 is performed when a predetermined amount of molten metal has gathered at the front end of the cylinder 5, so that until this state is reached, molten metal needs to be prevented from flowing out through the nozzle 10. For this reason, the temperature of the nozzle 10 is controlled as follows. While molten metal is gathering at the front end of the cylinder 5, the nozzle 10 is obstructed by a cold plug made from molten metal that has solidified, and when molten metal is to be injected, the cold plug is removed by having it easily pressed out towards the die 9 together with the injected molten metal. An insulating member is provided between the die 9 and the nozzle 10 to stop the die 9 from absorbing heat from the nozzle 10 and thereby lowering the temperature of the nozzle 10. The nozzle 10 is made of a ceramic material.

The heater 6 provided around the circumference of the cylinder 5 has its temperature controlled separately for a plurality of zones so that the temperature gets higher along the cylinder 5 in its longitudinal direction towards the nozzle 10. As a light metal alloy is transported along the inside of the cylinder 5 by the screw 3, the temperature of the light metal alloy rises. At the front end of the cylinder 5, the temperature is controlled so that the light metal alloy is in a semimolten state below the melting point or in a molten state at a temperature between the melting point and just above the melting point.

The hopper 7, the feeder 8, the cylinder 5, and the passages joining these are filled with an inert gas (such as argon gas) to stop the light metal alloy from oxidizing.

The die 9 has a runner 11 that guides the molten metal injected from the nozzle 10. The runner 11 extends straight from the nozzle 10 of the cylinder 5 and then rises vertically to form an L-shape. A plug receptacle 11*a* is provided at the corner of the L-shape for receiving a cold plug that has been removed from the nozzle 10. The die 9 also includes a cavity 12 that is connected to the runner 11, a gate 13 that forms the boundary between the cavity 12 and the runner 11, and an overflow 14 that is positioned away from the gate 13 of the cavity 12 and accepts gas in the cavity 12 that has been displaced by molten metal.

<Injection Molding Method>

The following describes the method used for injection molding a light metal alloy.

First, chips of a light metal alloy (such as an Mg—Al alloy) are placed into the hopper 7 of the injection molding apparatus 1 as a raw material. A predetermined weight of the light metal alloy chips is measured in the feeder 8 and is supplied into the injection molding apparatus 1.

Thereafter, the light metal alloy chips are transported by the rotation of the screw 3 within the cylinder 5 while the cylinder 5 is heated. Within the cylinder 5, the light metal alloy chips are sufficiently stirred and kneaded by the rotation of the screw 3 while being heated to a predetermined temperature. As a result, the light metal alloy chips become a semimolten light metal alloy with a solid phase proportion of at least 10%.

The molten metal produced in this manner is pushed forward by the screw 3 and gathers at the front end of the cylinder 5, with the screw 3 retracting due to the pressure of the molten metal that gathers in this manner. At this point, the temperature of a plug provided in the cylinder 5 is reduced, resulting in some of the molten metal solidifying, producing a cold plug that covers the nozzle 10, and stops the molten metal from flowing past the nozzle 10 out of the cylinder 5.

When the screw 3 has retracted a predetermined distance, this is detected by the injecting mechanism of the main body 2 which stops the rotation and retraction of the screw 3. At this point, sufficient molten metal for a single injection is gathered at the front end of the cylinder 5.

Next, the discharging mechanism has the screw 3 advance to apply pressure onto the molten metal. As a result, the molten metal presses out the cold plug towards the die 9 and molten metal is injected from the nozzle 10 into the cavity 12. The cold plug removed in this manner is caught by the plug receptacle 11*a* in the runner 11.

Finally, after the molten metal has solidified, the die 9 is opened and the injection molded article (the article for forging) is removed.

Pre-forging Heat Treatment

The article for forging produced by the above injection molding is subjected to a pre-forging heat treatment (a pre-plastic working heat treatment) with a processing time of at least one hour and a processing of temperature that is lower than the temperature at which eutectic of the light metal alloy that forms the article for forging starts to be fused. Preferably, the pre-forging heat treatment is performed with a processing temperature in a range of 350 to 450° C. and a processing time in a range of 10 to 20 hours. During this heat treatment, the homogeneity of material composition of the article for forging is raised, while the expansion of gas defects near the surfaces of the article for forging results in the appearance of blisters in the surface of the article for forging.

Forging Process

The article for forging that has been subjected to the pre-forging heat treatment is subjected to either fully enclosed die forging (fully enclosed die plastic working) or non-fully enclosed die forging (non-fully enclosed die plastic working). Fully enclosed die forging is performed in a forging die whose forging space is completely closed, while non-fully enclosed die forging is performed in a forging die where at least part of the article for forging is not inhibited and so is free to deform plastically. During forging, some of the blisters that are produced in the surface of the article for forging by the pre-forging heat treatment are ruptured and thereby eradicated.

Post-Forging Heat Treatment

The forged article that has been shaped by the forging process is then subjected to a post-forging heat treatment (a post-plastic working heat treatment) with a processing temperature in a range of 250 to 400° C. and a processing time in a range of 20 minutes to 10 hours. The resulting article is the "shaped light metal article" referred to in this specification.

With the above manufacturing method for shaped light metal article, the forged article is subjected to a post-forging heat treatment that has a higher temperature and a shorter processing time than the ageing precipitation hardening treatment performed during a T6 treatment. The ductility of the article can be effectively improved, while maintaining the strength and yield strength of the article.

Before forging, the article for forging is also subjected to a pre-forging heat treatment that has a higher temperature and a longer processing time than the post-forging heat treatment. As a result, gas defects present near the surfaces of the article for forging expand to produce blisters in the surface of the article for forging. Some of these blisters are ruptured and eradicated by the forging process, resulting in a reduction in the number of gas defects present in the article for forging. The creation of blisters before forging and the eradication of these blisters during forging are followed by a post-forging heat treatment that can be performed at a low temperature for a short time, so that the creation of blisters by the post-forging heat treatment can be suppressed, resulting in a favorable appearance for the shaped light metal article produced by this method.

The processing time for the pre-forging heat treatment is at least one hour, so that blisters can be effectively produced in the surface of the article for forging and, like the solution treatment performed as part of a T6 treatment, the homogeneity of the material composition can be raised.

Since the proportion of internal defects in the article for forging is 10% or less, forged article with extremely few internal defects can be produced even by non-fully enclosed die forging, where the complete removal of internal defects is extremely difficult. The forged article with few internal defects can therefore be produced without placing restrictions on the forging method used.

When the article for forging is being injection molded, semimolten light metal alloy is introduced into the cavity in the die and solidifies. This molten metal enters the cavity as a laminar flow or near-laminar flow, making it difficult for air to become trapped in the material. As a result, article for forging with few internal defects, such as gas defects or shrinkage cavities, can be produced. This means that high-quality article for forging and shaped light metal article can be manufactured.

Alternative Embodiments

While the above embodiment describes the case where the light metal alloy chips are heated so as to become semimolten metal with a solid phase proportion of at least 10%, the light metal chips may be heated to a molten state at the melting point or just above the melting point.

While the above embodiment describes the case where the article for forging is produced by injection molding, this is not a particular limitation for the present invention, so that the article for forging may be shaped using a different method.

Experiment 1

The relationship between the processing temperature used in the post-forging heat treatment performed on the forged article and the strength, the 0.2% yield strength, and the elongation after fracture of the forged article after the heat treatment were investigated through experimentation.

<Method of Experimentation>

An injection molded article in the form of a metal plate was made by the injection molding apparatus from the alloy A whose composition is shown in FIG. 2. During production, temperature control was performed for the molten metal so that the solid phase proportion of the produced injection molded article was 5%, with the solid phase proportion being confirmed from image analysis of the surface of the injection molded material. The alloy A used here is AZ91D under ASTM Standards. In the same manner, an injection molded artricle in the form of a metal plate was made by the injection molding apparatus from the alloy B whose composition is shown in FIG. 2. During production, temperature control was performed for the molten metal so that the solid phase proportion of the produced injection molded material was 10%.

Several articles for forging in the form of blocks which, as shown in FIG. 3A, are 10 mm wide, 35 mm long, and 21 mm thick were cut out from the injection molded article in the form of a metal plate made from each of the alloys A and B. The blocks made from alloy A were then subjected to a pre-forging heat treatment with a temperature of 410° C. for 16 hours, while the blocks made from alloy B were subjected to a pre-forging heat treatment with a temperature of 400° C. for 10 hours.

Once the pre-forging heat treatment was completed, each of the articles for forging was then constricted in the width direction and, as shown in FIG. 3B, was forged until its thickness was reduced by half from 21 mm to 10.5 mm (a forging working rate of 50%).

The forged articles made from the alloys A and B were then subjected to a post-forging heat treatment for four hours at the following temperatures: 170° C., 250° C., 300° C., 350° C., and 400° C. For comparison purposes, some forged articles were not subjected to a post-forging heat treatment.

Thereafter, a tensile test was performed on the shaped light metal articles that were subjected to the post-forging heat treatment and the forged articles that were not subjected to the post-forging heat treatment.

The shaped light metal articles made of alloys A and B that were subjected to a post-forging heat treatment at 300° C., 350° C., and 400° C. had their microstructures examined using a microscope following the tensile tests. For comparison purposes, the shaped light metal article that was not subjected to a pre- and post-forging heat treatment but was instead subjected to a T6 treatment were also examined. The T6 treatment for alloy A included a solution treatment for 16 hours at 410° C. and an ageing precipitation hardening treatment for 16 hours at 170° C., while the T6 treatment for alloy B included a solution treatment for 10 hours at 400° C. and an ageing precipitation hardening treatment for 16 hours at 175° C.

<Results of Experiment>

Figure 4:
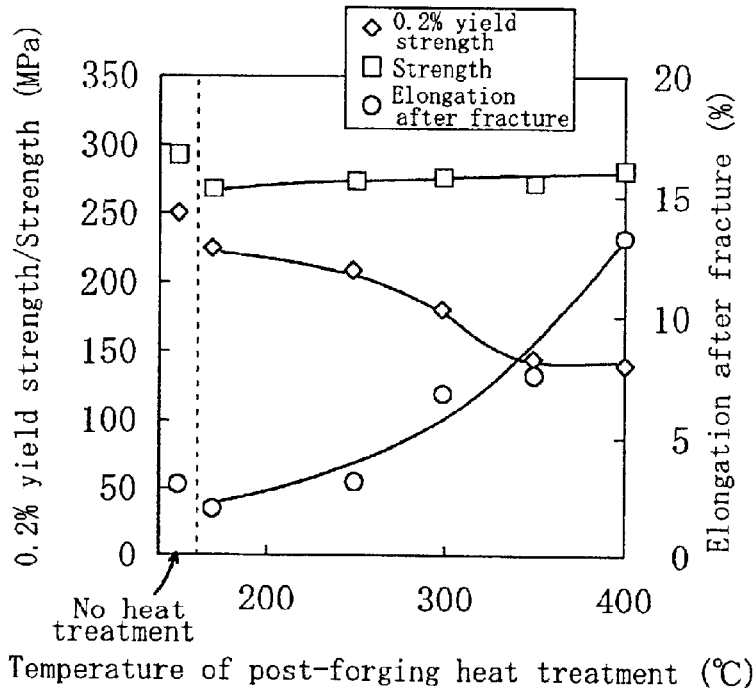
FIG. 4 is a graph showing the relationship between the processing temperature used in the post-forging heat treatment performed on alloy A and the 0.2% yield strength, the strength, and the elongation after fracture of the shaped light metal article.
Figure 5:
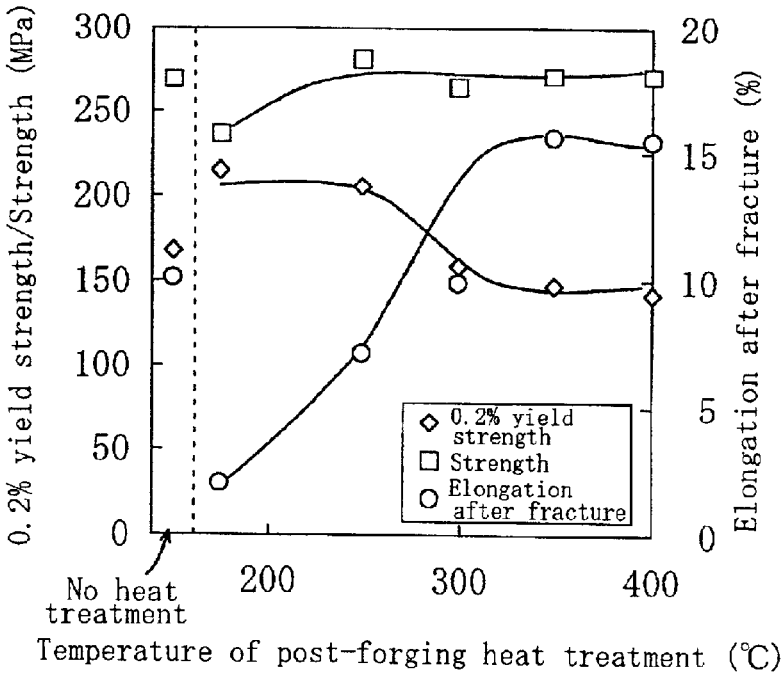
FIG. 5 is a graph showing the relationship between the processing temperature used in the post-forging heat treatment performed on alloy B and the 0.2% yield strength, the strength, and the elongation after fracture of the shaped light metal article.

FIG. 4 shows the relationship between the processing temperature used in the post-forging heat treatment performed on alloy A and the 0.2% yield strength, the strength, and the elongation after fracture of the forged article, while FIG. 5 shows the equivalent relationship for alloy B. From FIGS. 4 and 5, it can be seen that for both alloy A and alloy B, as the processing temperature increases, there is a tendency for 0.2% yield strength to decrease, a tendency for strength to increase gradually, and a tendency for elongation after fracture to increase. Regarding elongation after fracture, heat treatment with a processing temperature equal to a temperature (170 to 230° C.) used in the ageing precipitation hardening treatment in a T6 treatment results in lower elongation after fracture than the case when heat treatment is not performed. However, when the processing temperature is 250° C. or higher, a large improvement is made in elongation after fracture, without causing a large decrease in 0.2% yield strength or in strength.

Figure 6A:
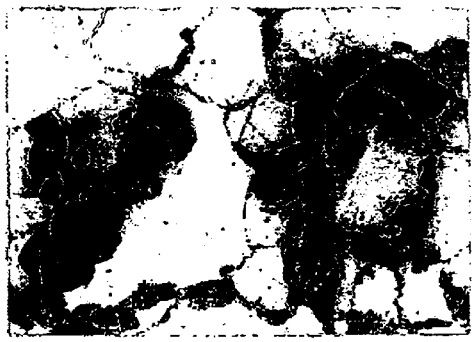
FIG. 6 shows are photographs of the microstructure of the surface of the shaped light metal article of alloy A taken using a microscope, the shaped light metal article having been subjected to a post-forging heat treatment with different conditions.
Figure 6B:
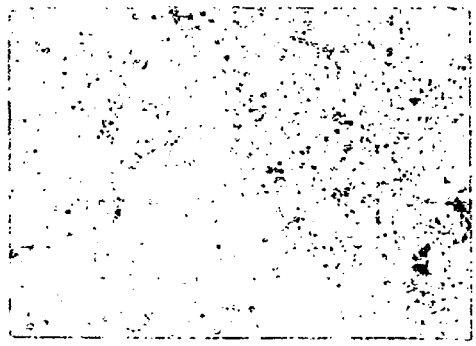
Figure 6C:
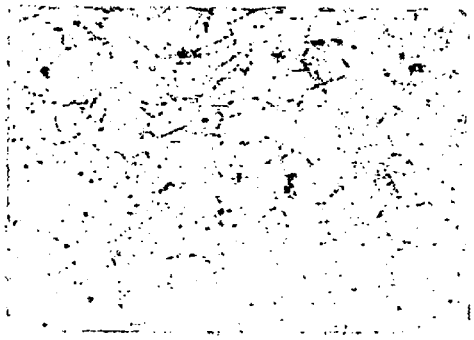
Figure 6D:
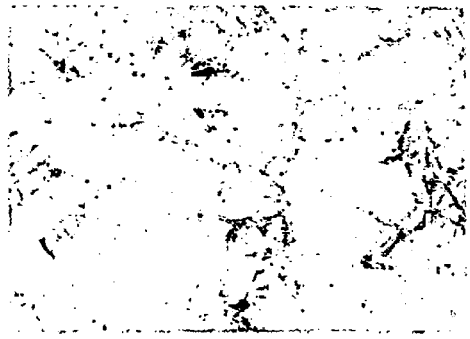
Figure 7A:
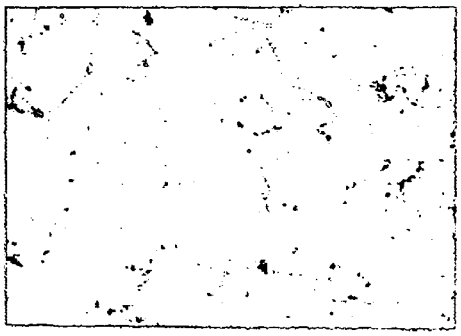
FIG. 7 shows photographs of the microstructure of the surface of the shaped light metal article of alloy B taken using a microscope, the shaped light metal article having been subjected to a post-forging heat treatment with different conditions.
Figure 7B:
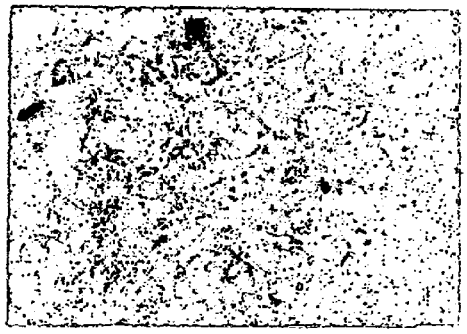
Figure 7C:
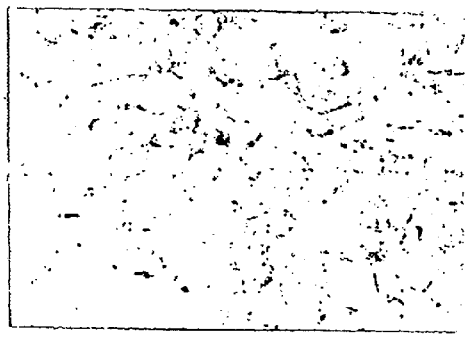
Figure 7D:
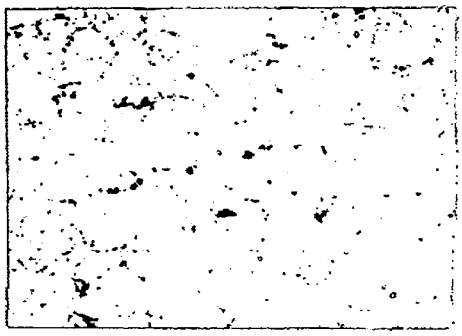

FIGS. 6A to 6D are drawings of the microstructure of the surface of the shaped light metal article made from the alloy A. FIG. 6A shows the article that was subjected to a T6 treatment, FIG. 6B shows the article that was heat treated at 300° C., FIG. 6C shows the article that was heat treated at 350° C., and FIG. 6D shows the article that was heat treated at 400° C. FIGS. 7A to 7D are equivalent drawings of the microstructure of the shaped light metal article made from the alloy B. In FIGS. 6 and 7, coarsening of the crystal grains was observed in FIGS. 6A and 7A due to the segregation (the black parts of the drawings) of a compound ($Mg_{17}Al_{12}$) in the alloy A. On the other hand, as for the shaped light metal articles that were subjected to a post-forging heat treatment with a higher temperature and shorter processing time than the T6 treatment, there was no clear evidence of grain boundaries and precipitation of compound was homogenous for the articles produced using a processing temperature of 300° C. (see FIGS. 6B and 7B). For the articles produced using a processing temperature of 350° C. (see FIGS. 6C and 7C), fine grain boundaries were observed, and precipitation of compound was homogenous. For the articles produced using a processing temperature of 400° C. (see FIGS. 6D and 7D), coarsening of the crystal grains was observed, but the precipitation of compound was homogenous.

From the results for the tensile test and the observation results for microstructure, it is believed that the material composition forming the shaped light metal article following the post-forging heat treatment affects the ductility of the material. That is to say, a composition in which recrystallization has not occurred is not susceptible to changes in form, making the material strong but not ductile. When recrystallization occurs, the crystal grains change form, making the material ductile. However, it is believed that when the crystal grains become too large, it becomes difficult for the crystal grains to change shape, making the material brittle and lowering both the strength and ductility of the material.

Accordingly, in order to produce very strong shaped light metal article, the processing temperature used in the post-forging heat treatment is set at a temperature that produces a material composition where crystal grains cannot be observed. To produce a highly ductile shaped light metal article, the processing temperature used in the post-forging heat treatment is set at a temperature that produces a material composition where fine crystal grains can be observed.

Experiment 2

The relationship between the processing time used in the post-forging heat treatment performed on the forged article and the 0.2% yield strength, the strength, and the elongation after fracture of the forged article after the heat treatment were investigated through experimentation.

<Method of Experimentation>

In the same manner as Experiment 1, several articles for forging were produced from each of the alloys A and B in the form of blocks which, as shown in FIG. 3A, are 10 mm wide, 35 mm long, and 21 mm thick. The blocks made from alloy A were then subjected to a pre-forging heat treatment with a temperature of 410° C. for 16 hours, while the blocks made from alloy B were subjected to a pre-forging heat treatment with a temperature of 400° C. for 10 hours.

Once the pre-forging heat treatment was completed, each of the articles for forging was then constricted in the width direction and, as shown in FIG. 3B, was forged until its thickness was reduced by half from 21 mm to 10.5 mm (a forging working rate of 50%).

The forged articles made from the alloys A and B were then subjected to a post-forging heat treatment at 300° C. for alloy A and 350° C. for alloy B for the following processing times: 1 hour, 4 hours, 10 hours, and 15 hours.

After this, a tensile test was performed on the shaped light metal articles that were subjected to the post-forging heat treatment.

<Results of Experiment>

Figure 8:
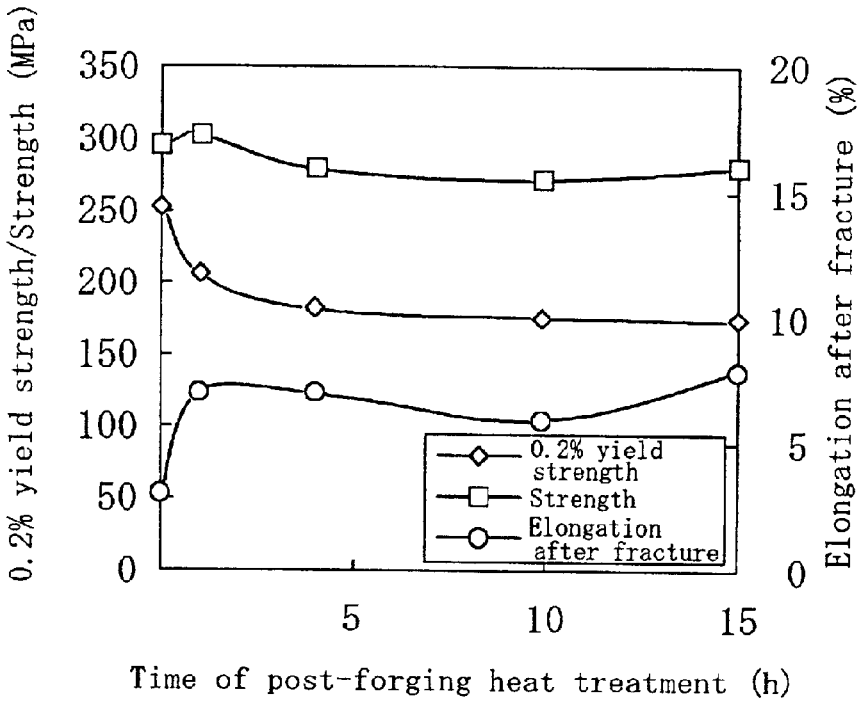
FIG. 8 is a graph showing the relationship between the processing time used in the post-forging heat treatment performed on alloy A and the 0.2% yield strength, the strength, and the elongation after fracture.
Figure 9:
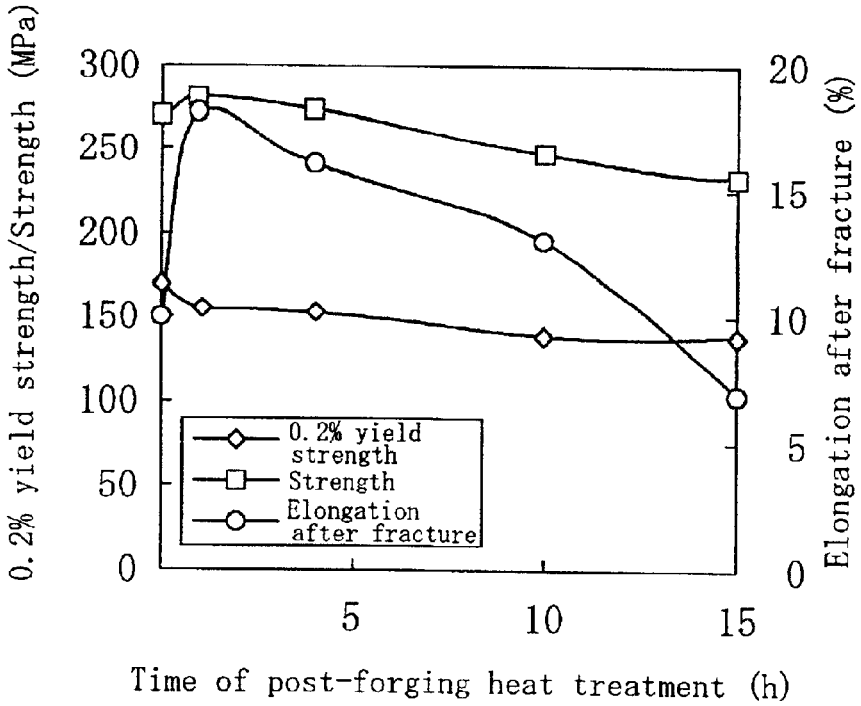
FIG. 9 is a graph showing the relationship between the processing time used in the post-forging heat treatment performed on alloy B and the 0.2% yield strength, the strength, and the elongation after fracture.

FIG. 8 shows the relationship between the processing time used in the post-forging heat treatment performed on alloy A and the 0.2% yield strength, the strength, and the elongation after fracture of the shaped light metal article, while FIG. 9 shows the equivalent relationship for alloy B. The data for the processing time 0 is the data for the forged articles that were not subjected to a post-forging heat treatment in Experiment 1. From FIGS. 8 and 9, it can be seen that for both alloy A and alloy B, when the processing time is up to one hour, there is a tendency for 0.2% yield strength to decrease significantly, though the decrease in 0.2% yield strength becomes gradual as the processing time is extended beyond one hour. A slight increase in strength is observed for processing times up to one hour, though the tendency is for strength to decrease gradually as the processing time is extended beyond one hour. On the other hand, a tendency for significant improvement in the elongation after fracture of alloy A was observed for processing times up to one hour, with no significant change in elongation after fracture being observed as the processing time is extended beyond one hour. For alloy B, it can be seen that elongation after fracture peaks when the processing time is one hour, and tends to decrease as the processing time is extended beyond one hour. From the above results, it can be seen that for both alloy A and alloy B, a large improvement in elongation after fracture can be obtained in the first hour of heat treatment, and that for alloy B, a shaped light metal article with a large improvement in elongation after fracture can be obtained by setting the processing time at 10 hours or shorter (preferably 5 hours or shorter).

Experiment 3

The relationship between the relative density of the article for forging before non-fully enclosed die forging and the relative density of the article for forging after non-fully enclosed die forging was investigated through experimentation.

<Method of Experimentation>

Figure 10A:
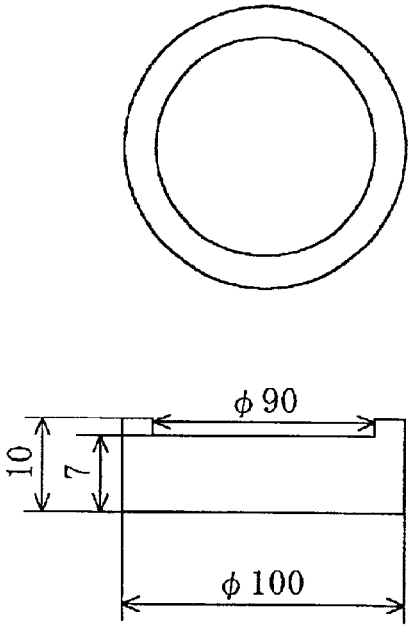
FIG. 10 shows top plan views and sectional side views of an article for forging and a forged article.

An injection molding apparatus was used to produce, under various conditions, cylindrical articles for forging that, as shown in FIG. 10A, have a 3 mm deep circular depression in an upper surface. These articles for forging were made from the alloy C whose composition is shown in FIG. 2. The density of the resulting articles for forging was measured using Archimedean's Method, the measurements were divided by a theoretical density that assumes there are no internal defects such as was defects, and the results were multiplied by one hundred to produce relative density values. Several articles for forging were prepared for each of the relative densities 85%, 90%, and 95%.

Figure 10B:
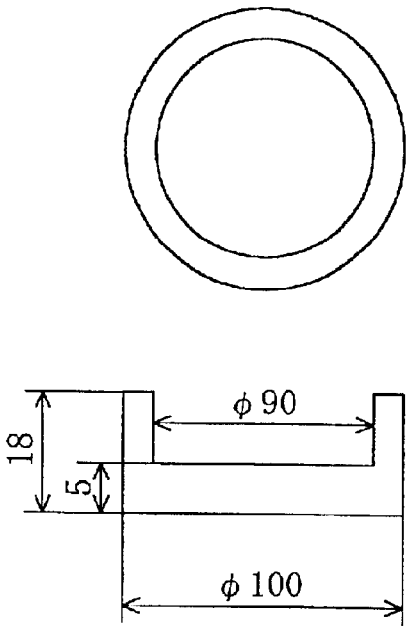

The articles for forging described above were then subjected to non-fully enclosed die forging until the shape shown in FIG. 10B was obtained. The densities of the resulting forged articles were then measured as described above, and the relative density of each forged article was calculated.

<Results of Experiment>

Figure 11:
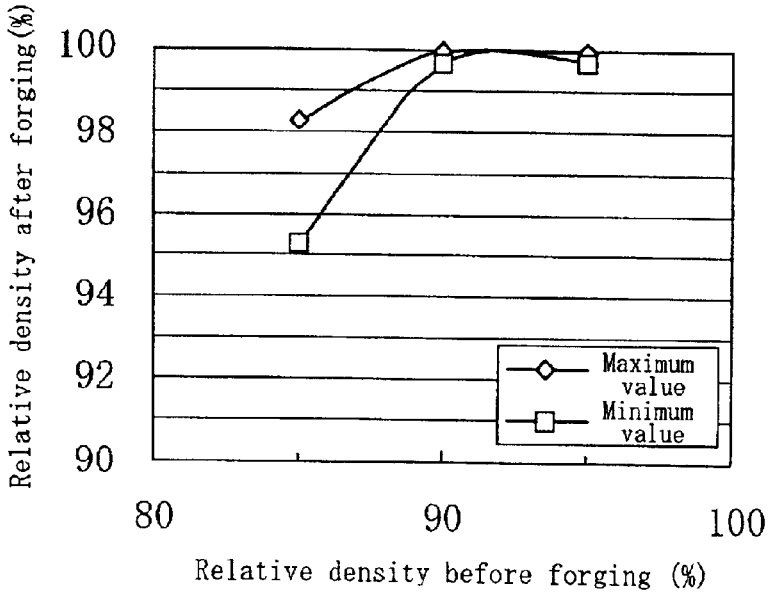
FIG. 11 is a graph showing the relationship between the relative densities of the article for forging before forging and the maximum and minimum value for the relative density of the forged article.

FIG. 11 shows the relationship between the relative density of the article for forging before forging and the maximum and minimum values for the relative density of the forged article (i.e., the article for forging after forging). From FIG. 11, it can be seen that when the relative density of the article for forging before forging is below 90%, the relative density of the forged article after forging is 99% or below, with there being a large degree of deviation. That is, when the relative density is below 90% (which is to say, internal defects amount for over 10% of volume), non-fully enclosed die forging cannot sufficiently eradicate the internal defects, so that forging cannot sufficiently increase the strength of the material.

Experiment 4

The relationship between the solid phase proportion of the article for forging produced by injection molding and the relative density was investigated through experimentation.

<Method of Experimentation>

The injection molding apparatus was used to form injection molded articles for forging of alloy A in the form of a metal plate while varying the temperature of the molten metal, which is to say, the solid phase proportion. During formation, the molten metal was injected into the cavity of the die at a speed of 10 m/s. The solid phase proportion was confirmed through image analysis of the surface of the injection molded article.

The relative densities of the articles for forging produced in this manner were then calculated in the same manner as in Experiment 3.

<Results of Experiment>

Figure 12:
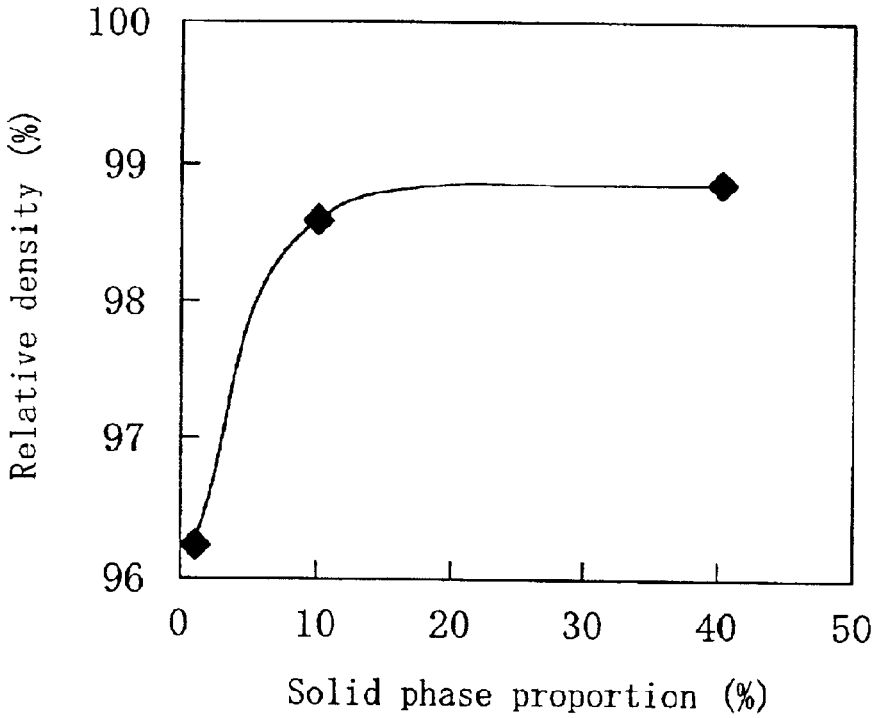
FIG. 12 is a graph showing the relationship between the solid phase proportion of molten metal and the relative density of an injection molded article.

FIG. 12 shows the relationship between the solid phase proportion and the relative density of article for forging. As can be seen in FIG. 12, a high relative density can be obtained for an article for forging by injection molding molten metal in a semimolten state. In more detail, when the solid phase proportion is 10% or higher, an article for forging with a high relative density can be reliably produced. This is believed to be due to semimolten metal with a solid phase proportion is 10% or higher having very high viscosity, so that the molten metal flows in the cavity slowly as a laminar flow. When the solid phase proportion is 10% or above, improvements in relative density were not observed and a relative density of 100% was not achieved. This is thought to be due to the unavoidable creation of shrinkage cavities in the articles for forging.

Experiment 5

The differences in the microstructure of the surface of the articles for forging before and after the pre-forging heat treatment were investigated through experimentation.

<Method of Experimentation>

In the same manner as in Experiment 1, plate-like injection molded articles in the form of a metal plate were formed by injection molding alloys A and B. The microstructures of these injection molded articles were then observed using a microscope.

Thereafter, the injection molded article made from alloy A was subjected to a heat treatment with a temperature of 410° C. for 16 hours, while the injection molded article made from alloy B was subjected to a heat treatment with a temperature of 400° C. for 10 hours. After this heat treatment, the microstructures were again observed using a microscope.

<Results of Experiment>

Figure 13A:
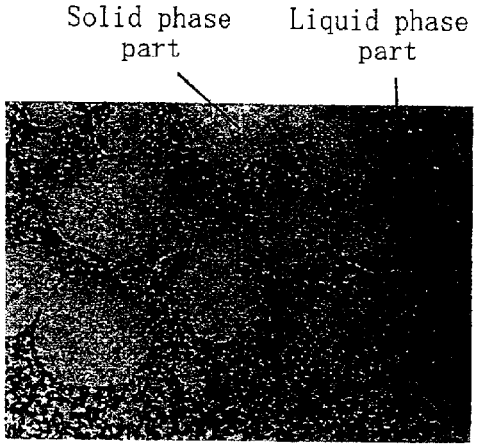
FIG. 13 shows photographs of the microstructure of the surface of an injection molded article taken using a microscope before and after heat treatment.
Figure 13B:
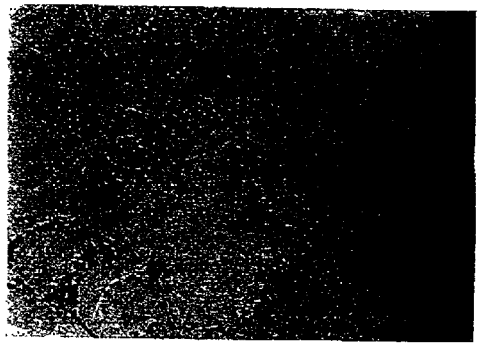
Figure 13C:
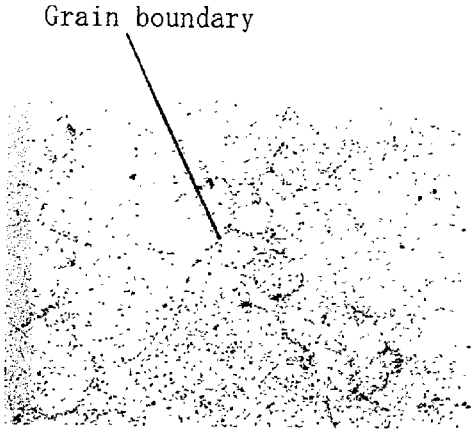
Figure 13D:
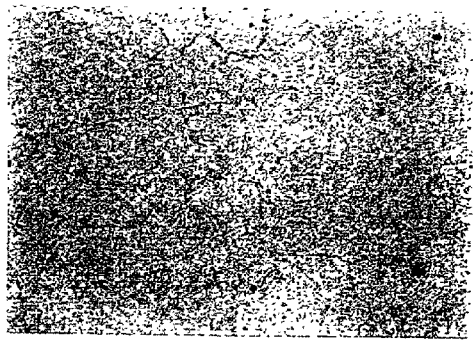

FIGS. 13A to 13D are drawings of the microstructure of the surface of injection molded article before and after the heat treatment. FIG. 13A shows the injection molded article made from alloy A before heat treatment, FIG. 13B shows the injection molded article made from alloy B before heat treatment, FIG. 13C shows the injection molded article made from alloy A after heat treatment, and FIG. 13D shows the injection molded article made from alloy B after heat treatment. As can be seen from these drawings, the microstructures of the injection molded articles made from both alloy A and alloy B are very different before and after the heat treatment. In more detail, before heat treatment, the solid phase parts of the injection molded article are conspicuous, while crystallization of $Mg_{17}Al_{12}$ occurs in the liquid phase parts (the black areas in the liquid phase parts). On the other hand, after the heat treatment, it is difficult to clearly distinguish the solid phase parts that were observed before the heat treatment was performed. The $Mg_{17}Al_{12}$ dissolves, and so can hardly be observed. Some grain boundaries can be made out faintly.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A method of manufacturing a shaped light metal article, comprising the steps of:

performing a pre-plastic working heat treatment on an article for plastic working to produce blisters in a surface thereof due to expansion of gas included therein, the pre-plastic working heat treatment being performed at a temperature in a range of 350 to 450° C. for between 16 and 20 hours, and the article for plastic working being made of light metal material and including internal defects wherein the internal defects are no more than 10% of a volume thereof;

forming a plastic worked article by plastic working the article for plastic working of which the blisters are produced in the surface; and subjecting the plastic worked article to a post-plastic working heat treatment at a temperature in a range of 250 to 400° C. for between 20 minutes and 5 hours.

2. The method of manufacturing a shaped light metal article according to claim 1, wherein the light metal is a magnesium alloy.

3. The method of manufacturing a shaped light metal article according to claim 1, wherein the article for plastic working is formed by solidifying semimolten light metal.

4. The method of manufacturing a shaped light metal article according to claim 1, wherein the article for plastic working is formed by injection molding molten light metal.

5. The method of manufacturing a shaped light metal article according to claim 4, wherein the molten light metal is in a semimolten state below a melting point of the light metal.

* * * * *